United States Patent [19]

Varano

[11] Patent Number: 4,680,023

[45] Date of Patent: Jul. 14, 1987

[54] CONTAINER FORMING APPARATUS HAVING IN-LINE BLANKER

[75] Inventor: Richard F. Varano, Forestville, Conn.

[73] Assignee: Sherwood Tool, Incorporated, Kensington, Conn.

[21] Appl. No.: 725,093

[22] Filed: Apr. 19, 1985

[51] Int. Cl.[4] ..... B31B 1/60

[52] U.S. Cl. ..... 493/75; 493/10; 493/62; 493/74; 493/104; 271/3.1; 83/94; 83/96

[58] Field of Search ..... 493/10, 22, 62, 61, 493/73, 74, 104, 105, 106, 107; 271/3.1; 72/424, 338, 333; 83/89, 90, 91, 94, 96, 92, 92.1

[56] References Cited

U.S. PATENT DOCUMENTS

| | | | |
|---|---|---|---|
| 1,786,477 | 12/1930 | Carle | 493/106 |
| 2,674,929 | 4/1954 | Wittkuhns et al. | 493/74 |
| 2,864,612 | 12/1958 | Dellinger et al. | 493/106 |
| 2,881,836 | 4/1959 | Thiem et al. | 83/90 |
| 3,630,122 | 12/1971 | Chambon | 83/94 |
| 3,924,499 | 12/1975 | Dechambre et al. | 83/92 |
| 3,926,081 | 12/1975 | Roberts | 83/96 |
| 4,227,683 | 10/1980 | Spangler et al. | 493/10 |
| 4,364,549 | 12/1982 | Komossa et al. | 271/3.1 |

*Primary Examiner*—Robert L. Spruill
*Assistant Examiner*—David B. Jones
*Attorney, Agent, or Firm*—McCormick, Paulding & Huber

[57] ABSTRACT

Apparatus for making paper receptacles includes a magazine fed rotary turret receptacle forming machine having a magazine defined by a plurality of spaced apart and upwardly extending magazine rods. An independently operable blanking machine continuously supplies receptacle blanks to the forming machine and includes a die set and a plurality of spaced apart guide rods which depend from the die set and form an upward extension of the magazine.

15 Claims, 8 Drawing Figures

CONTAINER FORMING APPARATUS HAVING IN-LINE BLANKER

This invention relates in general to magazine fed container forming apparatus and deals more particularly with improvements in machines for forming paper receptacles. The invention is more particularly concerned with improvements in machines for cutting paper blanks used in magazine fed rotary turret type receptacle forming machines.

In a receptacle forming machine of the latter type, precut blanks supported in vertically stacked relation within a magazine are successively fed from the bottom of the magazine to a forming station where each successive blank is wrapped onto an associated mandrel mounted on a rotary turret and seamed to form the body portion of a receptacle. The mandrel with the receptacle body thereon may then be indexed by the turret to a plurality of successive work stations where a pre-formed receptacle bottom is joined with the body portion of the receptacle and further edge forming operations are performed to complete the receptacle.

The paper blanks from which receptacle bodies are formed are usually cut or otherwise shaped on another machine, stacked, and manually loaded into the magazine of the receptacle forming machine. Customarily, one machine operator may load and service several operating receptacle forming machines. However, when a service problem is encountered on one or more of the receptacle forming machines which interrupts the operator's normal machine loading cycle, the supply of receptacle blanks in the magazine or magazines of one or more of the other forming machines may become exhausted, causing the empty machine or machines to shut down resulting in costly machine down time.

Accordingly, it is the general aim of the present invention to provide an improved magazine fed receptacle forming apparatus of the aforedescribed general type which eliminates manual magazine loading operations and assures a substantially continuous supply of receptacle blanks to a receptacle forming machine at all times.

SUMMARY OF THE INVENTION

In accordance with the present invention an improved apparatus is provided which comprises a paper receptacle forming machine which has a receptacle forming station, an upwardly open magazine for receiving and containing a supply of vertically stacked receptacle blanks, and means for feeding successive receptacle blanks from the magazine to the forming station. In accordance with the invention the apparatus further includes an improved separate blanking machine operable independently of the receptacle forming machine and having blanking means for forming a succession of receptacle blanks and blank guiding means forming a vertical extension of the magazine for receiving receptacle blanks from the blanking means.

DETAILED DESCRIPTION OF PREFERRED EMBODIMENTS

Figure 1:
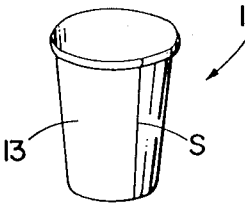
FIG. 1 is a perspective view of a typical receptacle of the type made using apparatus embodying the present invention.

The present invention is hereinafter illustrated and described with reference to apparatus for forming paper receptacles and more particularly cup-shaped containers, such as the container or cup shown in FIG. 1 and indicated generally by reference numeral 10. The apparatus, shown schematically in FIG. 2 and indicated generally by reference numeral 12, essentially comprises an improved vertical in-line blanking machine, indicated generally at 14, and a magazine fed receptacle forming machine designated generally by the numeral 16. The blanking machine 14 cuts or punches receptacle blanks used to form the bodies of cup-shaped receptacles, such as the cup 10, and includes guide means which cooperate with and form a vertical extension of the magazine on the associated cup forming machine 14 for feeding receptacle blanks to the forming machine, all of which will be hereinafter more fully discussed.

Figure 5:
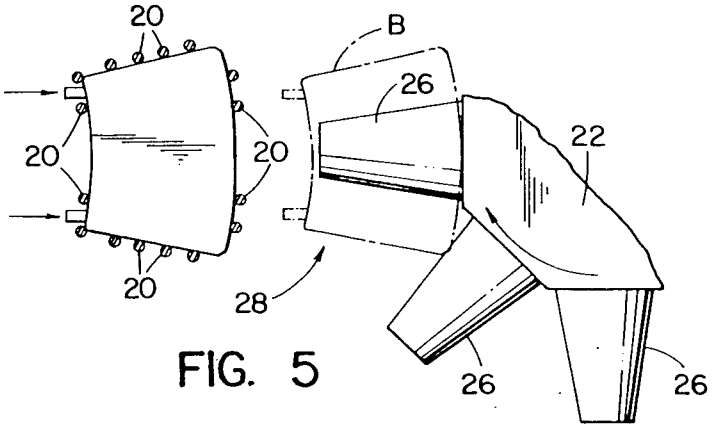
FIG. 5 is a fragmentary sectional view taken along the line 5—5 of FIG. 4.
Figure 6:
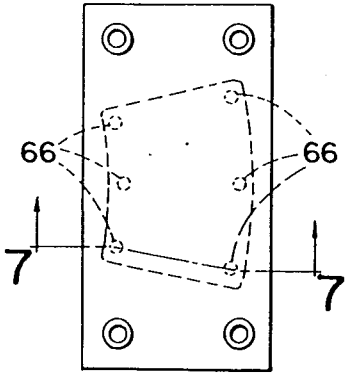
FIG. 6 is a somewhat schematic plan view of the die set shown in FIG. 4.
Figure 4:
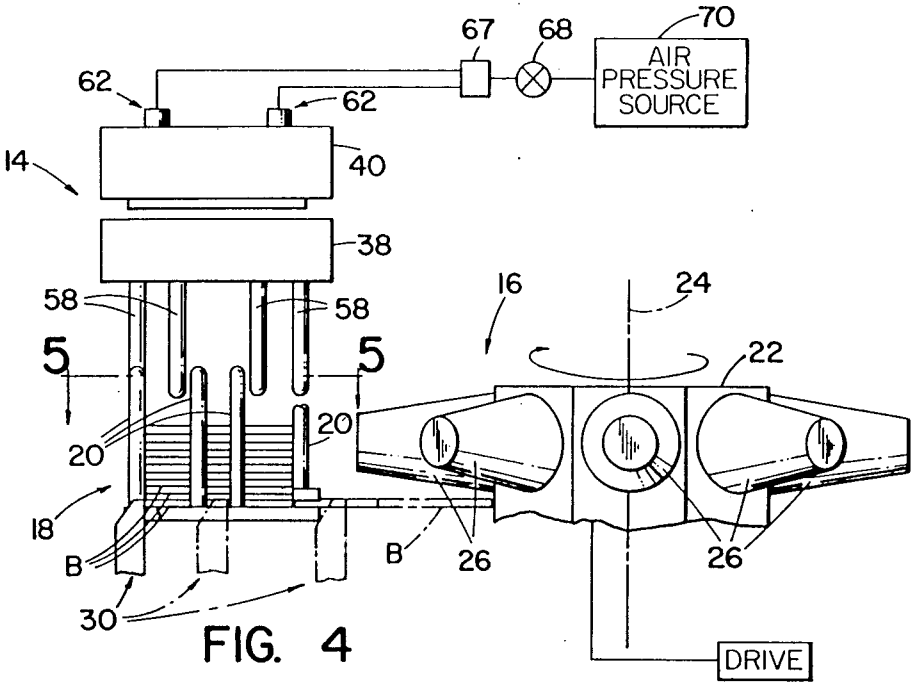
FIG. 4 is a somewhat enlarged schematic fragmentary side elevational view of a portion of the apparatus shown in FIG. 2.

The illustrated container forming machine 16, comprises a rotary turret type machine which may be of single or double turret type. It includes an upwardly open magazine indicated generally at 18 and defined, at least in part, by a plurality of spaced apart and vertically upwardly extending magazine rods 20, 20. The magazine is adapted to receive and contain in vertically stacked relation a plurality of receptacle blanks B, B from which body portions of receptacles, such as the cup 10 are formed. The machine 16 further includes at least one turret 22 supported for indexable rotation about a vertical axis 24, best shown in FIG. 4. A plurality of mandrels 26, 26 mounted on fixed position on the turret 22 project radially outwardly from it, as best shown in FIG. 5. The number of mandrels may vary, however, the illustrated turret 22 carries 8 mandrels and is particularly adapted for indexable rotation in 45 degree angular increments about its axis 24 to present each individual mandrel at a first forming station indicated generally at 28 and aligned with the magazine 18. Each successive container blank B in the magazine 18 is fed from the bottom of the magazine by an associated feeding mechanism, such as the pusher mechanism, shown somewhat schematically in FIG. 4 and indicated generally by the reference numeral 30, and to the forming station 28 wherein associated mechanism which comprises a part of the machine 16 wraps the blank B around a mandrel 26 and forms a seam S along the overlapping edges of the blank to complete a body portion of a receptacle, such as the cup 10. Thereafter, the mandrel with an associated receptacle body portion thereon is indexed to a further work station or stations where a receptacle bottom is joined to the body portion and required edge forming operations are performed, in a manner well known in the receptacle making art.

Receptacle forming machines of the aforedescribed general type are well known in the art. A typical double turret paper cup making machine of the type hereinbefore generally described is illustrated and described in somewhat more detail in U.S. Pat. No. 3,289,552 to Corazzo, assigned to the assignee of the present invention, and hereby adopted by reference as part of the present disclosure.

Figure 2:
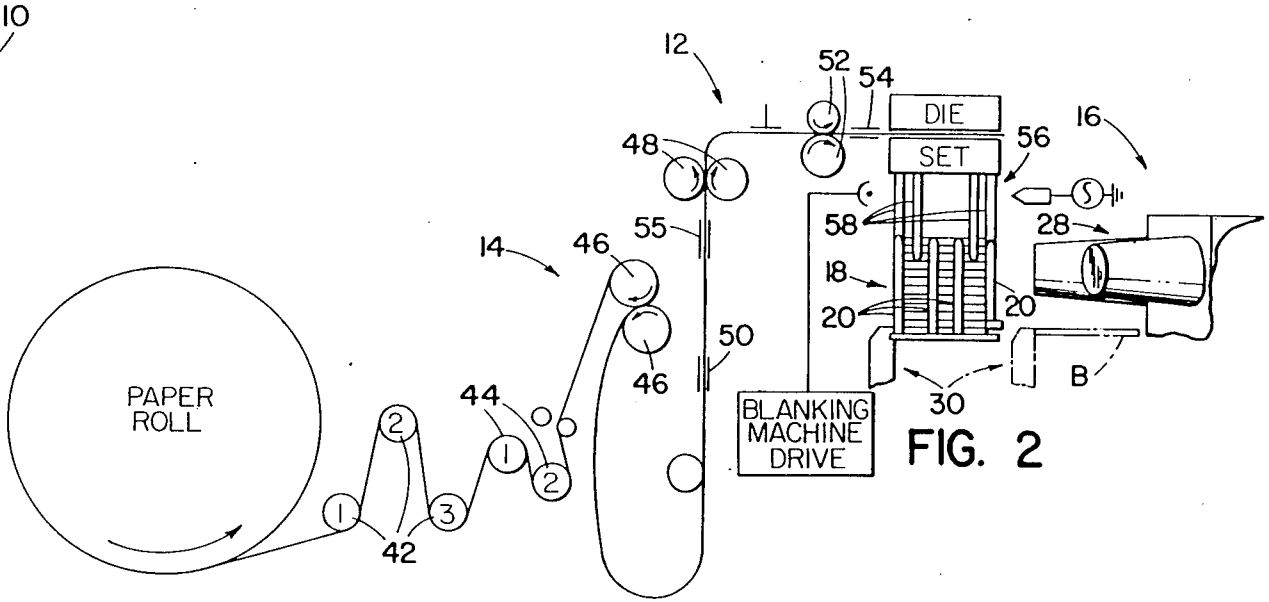
FIG. 2 is schematic side elevational view of apparatus embodying the present invention.
Figure 3:
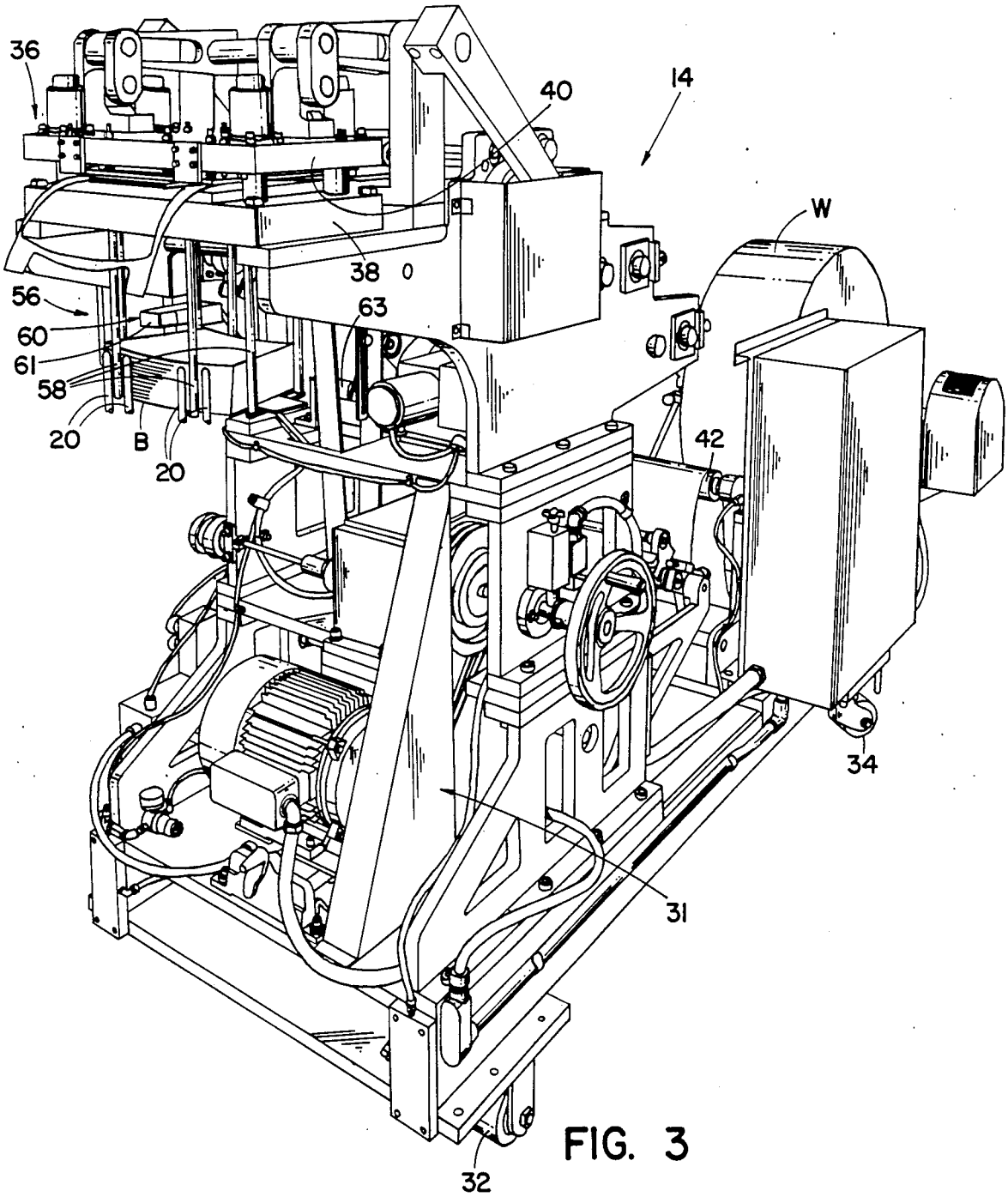
FIG. 3 is a perspective view of a vertical in-line blanking machine which comprises a part of the apparatus shown in FIG. 2.

Considering now the improved vertical in-line blanking machine 14 and referring particularly to FIGS. 2 and 3 of the drawings, the machine 14 is portable and includes a frame indicated generally at 31 which may, if desired, define a portion of the magazine 18. The frame 31 is mounted on a pair of front casters 32, 32 (one shown) and a pair of rear swivel casters 34, 34 (one shown) to facilitate travel along a substantially smooth horizontal floor surface. The machine 14 has a die set, indicated generally at 36, mounted on the upper forward end portion of the machine frame 31. The die set comprises a stationary die assembly 38 which includes a die and movable punch assembly 40 which includes a punch which complements the die. The punch is operated by an associated power driven toggle mechanism which moves it alternately toward and away from the die for punching blanks B,B from a web of paper W intermittently fed through the die set in timed relation to the operation of the die set. The machine 14 preferably includes means for loading a roll or web W of paper onto and supporting it on the machine frame 31. The web W is fed over and under a plurality of transversely extending rolls 42, 42 which are journalled on the frame 31 and cooperate to form a closed loop tensioning system. A decurling system which includes transversely extending decurling rolls 44, 44 flattens the curled web to assure the production of flat blanks B, B. First and second sets of drive rolls, indicated generally at 46, 46 and 48, 48 in FIG. 2, advance the web in a free loop through first guides 50 to a third set of drive rolls 52, 52 which advance the web through second guides 54 into and through the die set 36.

Preferably, the machine also includes a suitable scanning device for detecting registration marks on the paper web W to control the web feed mechanism and assure proper positioning of printed material in registration with the die set, all of which is well known in the blanking machine art.

In accordance with the present invention, the blanking machine 14 includes a guiding device, indicated generally at 56, which forms a vertical extension of the magazine 18 when the blanking machine 14 is properly positioned with respect to the receptacle forming machine 16. The presently preferred guiding device 56 comprises a plurality of parallel guide rods 58, 58 mounted on the stationary die assembly and depending from it. When the two machines are properly aligned the lower end portions of the guide rods 58, 58 are disposed between associated upper end portions of the magazine rods 20, 20 and cooperate with the magazine rods to form a vertically upwardly extending part of the magazine 18.

The illustrated blanking machine 12 further includes a sensing device, indicated generally at 60 in FIG. 3, associated with the guiding device 56 and responsive to the vertical height of a stack of container blanks within the confines of said magazine for controlling operation of the blanking machine 14. In the illustrated embodiment of the apparatus 12 the sensing device 60 comprises a photosensor 61, such as a photocell, phototube, phototransister, or the like, and a light source 63 mounted on the blanking machine 14 in vertically adjustable relation to the guiding device 56 for detecting the height a stack of blanks B, B within the magazine, or more specifically within the portion of the magazine defined by the guide rods 58, 58. The sensing device 60 is preferably connected through an amplifier to the blanking machine drive to stop the machine 14 when the stack height reaches a predetermined level within the magazine.

The sensing device 60 may be further arranged to restart the blanking machine 14 when the height of the stack of blanks B, B within the magazine 18 reaches a predetermined lower level, whereby to maintain a continuous supply of blanks B, B within the magazine 18 to assure uninterrupted operation of the container forming machine 16. Thus, for example, the sensing device 60 may include a suitable electrical switch operated by a timer for restarting the machine 14 after a predetermined shut-down time has elapsed.

Figure 7:
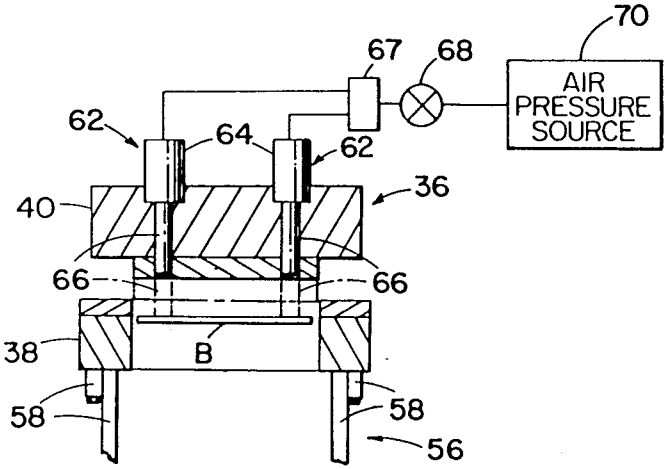
FIG. 7 is a sectional view taken generally along the line 7—7 of FIG. 6.

Preferably, and as shown, the blanking machine 14 further includes a blank engaging device for assuring separation of each successive cut blank B from the die set 36 and for urging the separated blank B into and through the guiding device 56 to a position at the top of the stack of blanks contained within the magazine 18. For this purpose, the illustrated blanking machine 14 further includes a plurality of fluid motors or pneumatic cylinders indicated generally at 62, 62 and mounted on the upper portion of the movable punch assembly 40 for movement with the punch assembly and relative to the die assembly 38. Each fluid motor 62 has a stationary part 64 which is mounted in fixed position on the punch assembly and a movable part or plunger 66 which extends through a vertical bore in the punch assembly and which is movable between retracted and extended positions, the latter positions being indicated respectively by full and broken lines in FIG. 7. The pneumatic cylinders 62, 62 are arranged for simultaneous operation and connected through a manifold 67 and a control valve 68 to a source of air under pressure, show schematically and indicated by the numeral 70. The control valve 68 operates in timed relation to the movement of the die set 36 and is or may be operated by the moving punch assembly 40.

The extending plungers 66, 66 engage the upper surface of a blank B as it is cut from the web W by the downwardly moving punch and to simultaneously exert a downward thrust at various points upon the surface of the cut blank to positively separate it from the die and urge it downwardly into the magazine formed by the depending guide rods 58, 58 and upstanding magazine rods 20, 20. The plungers are timed to operate once during each blanking cycle to accelerate the downward movement of each cut blank B as it separates from the die set 36 so that the blank is in a substantially horizontal orientation as it enters and travels within the magazine. This arrangement assures proper stacking of blanks B, B and prevents the falling blanks from interferring with the normal operation of the sensing device 60 which controls the operation of the machine 14.

Since the blanking machine 14 is wholly independent of the receptacle forming machine 16 which it serves, the blanking machine may be moved away from the forming machine to allow servicing of either machine. Preparatory to operating the apparatus 10 the blanking machine 14 is moved into position relative to the receptacle forming machine 16 so that the vertically extending portion of the magazine 18 defined by the depending guide rods 58, 58 is properly vertically aligned with the portion of the magazine defined by the magazine rods 20, 20. An alignment device is preferably provided to assure proper alignment of the two machines and may, for example, comprise a pin carried by one of the machines which enters a complementary adjustable alignment slot on the other of the machines. Since the magazine 18 is preferably adjustable to accommodate blanks which may vary in size and or shape the alignment device is preferably also adjustable. Preferably, the blanking machine 14 is anchored in fixed position relative to the receptacle forming machine 16 to assure proper alignment retention between the guide rods and the magazine rods at all times during operation of the apparatus 12.

Ocassionally, it may be necessary to remove defective blanks from the magazine to prevent these blanks from being fed into the forming machine, as for example, blanks printed out of registry or not sufficiently flat due to improper adjustment of the blanking machine. To facilitate blank removal the magazine may be provided with a gate.

Figure 8:
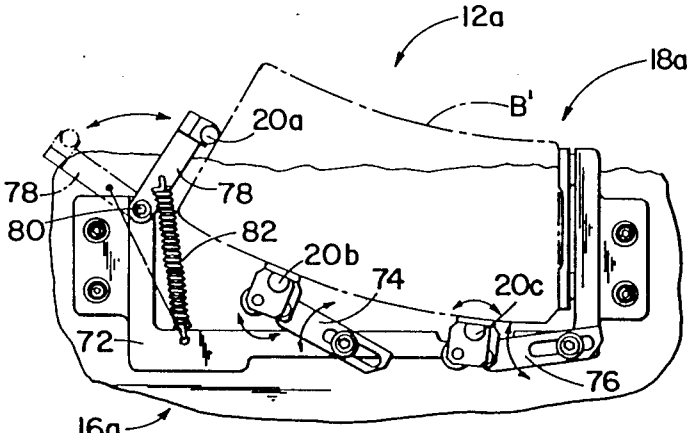
FIG. 8 is a somewhat further enlarged fragmentary plan view of a portion of a magazine which comprises part of another apparatus embodying the invention.

Referring now to FIG. 8, another apparatus embodying the invention is indicated generally at 12*a*. More specifically, in FIG. 8 there is shown a fragmentary plan view of a lower portion of a magazine 18*a* which comprises the apparatus 12*a* and which includes a movable gate.

The magazine 18*a* includes a base member 72 fastened to a surface plate on a forming machine 16*a*. A plurality of adjustable magazine rods designated 20*a*, 20*b* and 20*c* are fastened to the base member 72 and extend upwardly from it generally as previously described. The magazine rods 20*b* and 20*c* are carried by adjustable members 74 and 76 and may be fastened in selected positions of adjustment to accommodate blanks, such as the blank B' shown in phanthom, which may vary in size and or shape. The rod 20*a* is also adjustable, but comprises a movable gate carried by an elongated member 78 fastened to the base member 72 for pivotal movement about a vertical axis indicated at 80. The magazine rod 20*a* is spring biased toward a closed or full line position in FIG. 8 by a spring 82 but may be pivoted about its axis 80 to an open or broken line position to allow convenient removal of blanks, such as the blank B', from the magazine 18*a*, as necessary.

I claim:

1. Apparatus comprising a paper receptacle forming machine having a receptacle body forming station, a vertically disposed upwardly open magazine for receiving and containing a supply of vertically stacked receptacle blanks and defined at least in part by a plurality of vertically upwardly extending members, and means for feeding successive receptacle blanks from the bottom of a stack of a receptacle blanks in said magazine to said forming station, and a separate portable blanking machine operable independently of said receptacle forming machine and having blanking means disposed above the level of said magazine for forming a succession of receptacle blanks, and guide means mounted on and depending from said blanking machine for directing from said blanking means into said magazine receptacle blanks received from said blanking means, said guide means cooperating with said upwardly extending members and forming a substantial upward extension of said magazine.

2. Apparatus as set forth in claim 1 wherein said upwardly extending members comprise a plurality of horizontally spaced apart upwardly extending magazine rods and said guide means comprise a plurality of horizontally spaced apart downwardly extending guide rods.

3. Apparatus as set forth in claim 2 wherein said magazine is partially defined by a gate movable between open and closed positons.

4. Apparatus as set forth in claim 3 wherein said gate is defined by at least one of said magazine rods.

5. Apparatus as set forth in claim 2 wherein said rods have free end portions and free end portions of said guide rods are disposed between free end portions of said magazine rods.

6. Apparatus as set forth in claim 1 wherein said blanking machine has sensing means responsive to the vertical height of a stack of container blanks contained within said magazine for controlling operation of said blanking machine.

7. Apparatus as set forth in claim 6 wherein said sensing means comprises a photoelectric sensing device associated with said guide means.

8. Apparatus as set forth in claim 1 including blank engaging means for separating each successive container blank from said blanking means and urging it toward said guide means.

9. Apparatus as set forth in claim 1 wherein said magazine is partially defined by a gate movable between open and closed positions.

10. Apparatus as set forth in claim 1 including aligning means for properly positioning said portable blanking machine relative to said receptacle forming machine to align said guide means with said magazine.

11. Apparatus as set forth in claim 10 wherein said magazine is adjustable to accomodate blanks of varrying size and said aligning means is further characterized as adjustable aligning means.

12. Apparatus as set forth in claim 1 wherein said forming machine comprises a rotary turret receptacle forming machine having a turret supported for indexible rotation about a vertical axis and having an angularly spaced series of radially outwardly extending mandrels and means for indexing said turret to successively position each of said mandrels at said receptacle forming station.

13. Apparatus comprising a paper receptacle forming machine having a receptacle body forming station, a vertically disposed upwardly open magazine for receiving and containing a supply of vertically stacked receptacle blanks, said magazine being defined at least in part by a plurality of horizontally spaced vertically upwardly extending magazine rods having free upper ends, and means for feeding successive receptacle blanks from the bottom of a stack of receptacle blanks in said magazine to said forming station, and a separate portable blanking machine mounted on casters for movement along a floor and relative to said receptacle forming machine and operable independently of said receptacle forming machine, said blanking machine having blanking means disposed above the level of said magazine for forming a succession of receptacle blanks, guide means for directing from said blanking means into said magazine receptacle blanks received from said blanking means and defined at least in part by a plurality of horizontally spaced downwardly extending guide rods having free lower ends and depending from said blanking means, said free lower ends being disposed below the level of said free upper ends, said guide rods cooperating with said magazine rods to form a substantial upward extension of said magazine, means for aligning said portable blanking machine relative to said receptacle forming machine to align said guide rods in magazine defining relation with said magazine rods, and blank engaging means for separating each successive blanks formed by said blanking means from said blanking means and urging it toward said guide means.

14. Apparatus comprising a paper receptacle forming machine having a receptacle body forming station, an upwardly open magazine for receiving and containing a supply of vertically stacked receptacle blanks, and means for feeding successive receptacle blanks from said magazine to said forming station, and a blanking machine operable independently of said receptacle forming machine and having blanking means for forming a succession of receptacle blanks, guide means forming a vertical extending portion of said magazine for directing from said blanking means into said magazine receptacle blanks received from said blanking means, and blank engaging means for separating each successive container blank from said blanking means and urging it toward said guide means and including at least one fluid motor having a fixed part mounted in fixed position on said blanking means and a movable plunger operable in timed relation to the operation of said blanking means for engaging a blank formed by said blanking means to urge the blank into said magazine.

15. Apparatus as set forth in claim 14 wherein said blanking machine is mounted on casters to move along a floor and relative to said receptacle forming machine and including aligning means for positioning said blanking machine relative to said receptacle forming machine to position said guide means to form a vertical extension of said magazine.

* * * * *